US012590587B2

(12) United States Patent
Lin et al.

(10) Patent No.: US 12,590,587 B2
(45) Date of Patent: Mar. 31, 2026

(54) WATER PUMP WITH ONE INLET AND TWO OUTLETS

(71) Applicant: SHENZHEN MEGMEET ELECTRICAL CO., LTD., Shenzhen (CN)

(72) Inventors: Jinjie Lin, Shenzhen (CN); Pengfei Qiu, Shenzhen (CN); Zhili Zu, Shenzhen (CN)

(73) Assignee: SHENZHEN MEGMEET ELECTRICAL CO., LTD., Shenzhen (CN)

( * ) Notice: Subject to any disclaimer, the term of this patent is extended or adjusted under 35 U.S.C. 154(b) by 0 days.

(21) Appl. No.: 18/829,240

(22) Filed: Sep. 9, 2024

(65) Prior Publication Data

US 2025/0146504 A1 May 8, 2025

(30) Foreign Application Priority Data

Nov. 8, 2023 (CN) ..... 202311485458.6

(51) Int. Cl.

| | |
|---|---|
| ***F04D 29/22*** | (2006.01) |
| ***F04D 1/06*** | (2006.01) |
| ***F04D 13/06*** | (2006.01) |
| ***F04D 29/42*** | (2006.01) |

(52) U.S. Cl.

CPC ..... *F04D 29/2211* (2013.01); *F04D 1/06* (2013.01); *F04D 13/06* (2013.01); *F04D 29/4293* (2013.01)

(58) Field of Classification Search

CPC ..... F04D 29/2211; F04D 1/06; F04D 13/06; F04D 29/4293

See application file for complete search history.

(56) References Cited

U.S. PATENT DOCUMENTS

| | | | | |
|---|---|---|---|---|
| 3,970,408 | A * | 7/1976 | Rafferty | F04D 13/02 415/60 |
| 6,220,832 | B1 * | 4/2001 | Schob | F04D 13/14 417/423.5 |
| 2001/0014290 | A1 * | 8/2001 | Takura | F04D 3/02 417/423.5 |
| 2020/0116161 | A1 * | 4/2020 | Blad | F04D 13/06 |
| 2021/0254623 | A1 * | 8/2021 | Schöb | A61M 60/226 |
| 2022/0065255 | A1 * | 3/2022 | Maroccia | F04D 27/005 |

* cited by examiner

*Primary Examiner* — Andrew J Marien
(74) *Attorney, Agent, or Firm* — BAYES PLLC

(57) ABSTRACT

This application discloses a one-inlet and two-outlet water pump which comprises a pump body, and an impeller assembly and a motor assembly set inside the pump body. The motor assembly is connected to the impeller assembly. The impeller assembly comprises the first impeller and the second impeller connected to each other, with a hollow cavity formed between the first impeller and the second impeller. The design rotation direction of the first impeller blade is opposite to that of the second impeller blade. An inlet is set at one end of the pump body, corresponding to one end of the first impeller away from the second impeller. A first outlet and a second outlet are set on a side wall of the pump body, with the first outlet and the second outlet offset by a certain angle along a circumferential direction.

7 Claims, 5 Drawing Sheets

WATER PUMP WITH ONE INLET AND TWO OUTLETS

CROSS-REFERENCE TO RELATED APPLICATION

The present application claims the benefit of priority to Chinese Patent Application No. 202311485458.6, filed on Nov. 8, 2023, which is hereby incorporated by reference in its entirety.

TECHNICAL FIELD

This application pertains to the field of a pump, and in particular to a one-inlet and two-outlet water pump.

TECHNICAL BACKGROUND

The flushing system of intelligent toilets mainly comprises a water storage tank, a water pump, a shunt valve, a lateral flushing path and a bottom flushing path. Water flows from the water storage tank to the water pump under gravity. After being pressurized by the water pump, the water flows through the shunt valve, dividing into two paths, namely a lateral flushing path and a bottom flushing path.

In the related art, water pumps of intelligent toilets are generally set with one inlet and one outlet and are set with a unidirectional rotating impeller. The outlet is connected to the shunt valve which is set with a motor. The motor can drive the valve spool to rotate and change the angle of the valve spool, so as to adjust the flow rate and flushing duration of the lateral flushing path and the bottom flushing path.

However, the shunt valve has many disadvantages, such as many internal components, complex structure, and high production costs. In addition, the complex path in the valve body increases the local loss, which requires higher lift of water pumps. Furthermore, it is necessary to detect the position of the shunt sheet in the shunt valve with a detection device in order to achieve diversion. Above factors increase the production and maintenance costs of intelligent toilets.

SUMMARY

The main technical problem solved in this application is to provide a one-inlet and two-outlet water pump. This application can solve the problem of high costs caused by diversion by the shunt valve in the related art.

To solve above technical problem, the technical scheme in this application is to provide a one-inlet and two-outlet water pump which comprises a pump body, and an impeller assembly and a motor assembly set inside the pump body; the motor assembly is connected to the impeller assembly; the impeller assembly comprises a first impeller and a second impeller connected to each other, with a hollow cavity formed between the first impeller and the second impeller; wherein, a design rotation direction of the first impeller blade is opposite to that of the second impeller blade; an inlet is set at one end of the pump body, corresponding to one end of the first impeller far away from the second impeller; a first outlet and a second outlet are set on a side wall of the pump body, with the first outlet and the second outlet offset by a certain angle along a circumferential direction; the first outlet is positioned near the first impeller and the second outlet is positioned near the second impeller; wherein, the motor assembly, in response to being excited, drives the impeller assembly to rotate, causing the liquid to flow into the hollow cavity from the inlet, and flow out of the first outlet and the second outlet after being pressurized by the first impeller and the second impeller.

Wherein, the first impeller comprises the first front cover plate, the first impeller blade and the first rear cover plate arranged in sequence, with the first impeller blade fixedly connected to the first rear cover plate; the second impeller comprises the second front cover plate arranged in sequence, the second impeller blade and the second rear cover plate; the second front cover plate and the second rear cover plate are fixedly connected to the second impeller blade respectively; wherein, the first rear cover plate is fixedly connected to the second front cover plate, and both the first rear cover plate and the second front cover plate are hollow structures.

Wherein, the first impeller blade comprises a plurality of first blades evenly distributed along the circumferential direction; the second impeller blade comprises a plurality of second blades evenly distributed along the circumferential direction; wherein, the rotation direction of the first blades is opposite to that of the second blades.

Wherein, the first impeller and the second impeller are concentrically arranged, and the size of the first impeller is equal to or greater than that of the second impeller.

Wherein, the diameter of the inlet of the first impeller is 17~26 mm, the outer diameter of the outlet of the first impeller is 30~42 mm, the width of the outlet of the first impeller is 4~20 mm, and the number of the first blades is 5~7; the diameter of the inlet of the second impeller is 17~26 mm, the outer diameter of the outlet of the second impeller is 30~42 mm, the width of the outlet of the second impeller is 4~18 mm, and the number of the second blades is 5~7;

Wherein, the motor assembly comprises a spindle, a rotor and a rotor seat; the axis of the spindle is in the same straight line as the axis of the pump body, the spindle is contained in the hole of the rotor seat, and the rotor is nested within the rotor seat and is set on the periphery of the spindle; wherein, the rotor seat is fixedly connected to the second rear cover plate of the second impeller.

Wherein, a first sliding bearing is set between the rotor and the spindle, with gaskets positioned at both ends of the first sliding bearing; wherein, the first sliding bearing is tightly fitted with the rotor and the inner ring of the first sliding bearing rotates relative to the spindle.

Wherein, the pump body comprises the first pump case, the second pump case and a motor case arranged in sequence; the first pump case is set on the periphery of the first impeller, the second pump case is set on the periphery of the second impeller and the motor case is set on the periphery of the motor assembly; wherein, an inlet case is set at the end of the first pump case away from the second pump case, and a first outlet case is set on a side wall of the first pump case corresponding to the first outlet position on the side wall; a second outlet case is set at a side wall of the second pump case corresponding to the second outlet position on the side wall; the first outlet case and the second outlet case are offset by a certain angle along the circumferential direction.

Wherein, a pump cavity is formed between the first pump case and the second pump case; a connector is set between the first pump case and the second pump case; the connector is a hollow structure and is set on the periphery of the second impeller; wherein, a separator is formed between the connector and the second front cover plate of the second impeller to separate the pump cavity into the first pump cavity and the second pump cavity so as to prevent liquid overflowing from the first outlet from entering the second pump cavity.

Wherein, the connector is nested with the second sliding bearing near the second front cover plate of the second impeller.

The beneficial effects of this application are different from that of the related art. This application provides a one-inlet and two-outlet water pump. The pump body is provided with an impeller assembly which comprises two impellers with opposite design rotation directions. In addition, the pump body is provided with two outlets. The first outlet is near the first impeller and the second outlet is near the second impeller. The liquid is pressurized by the first impeller and the second impeller and flows out from the first outlet and the second outlet in order to achieve diversion. Further, two rotation directions of the impeller assembly and the change of rotation speed of the motor assembly can meet the different demands of intelligent toilets for flow rates and lifts of two outlets. The pump replaces the shunt valve, so as to reduce the production and maintenance costs of intelligent toilets.

BRIEF DESCRIPTION OF DRAWINGS

To provide a clearer explanation of the technical scheme in the embodiments of this application, a brief introduction will be given to the accompanying drawings required in the description of the embodiments. Obviously, the accompanying drawings in the following description are only some embodiments of the application. Ordinary persons skilled in the art can obtain other drawings based on these drawings without putting in creative labor.

DETAILED DESCRIPTION

Figure 1:
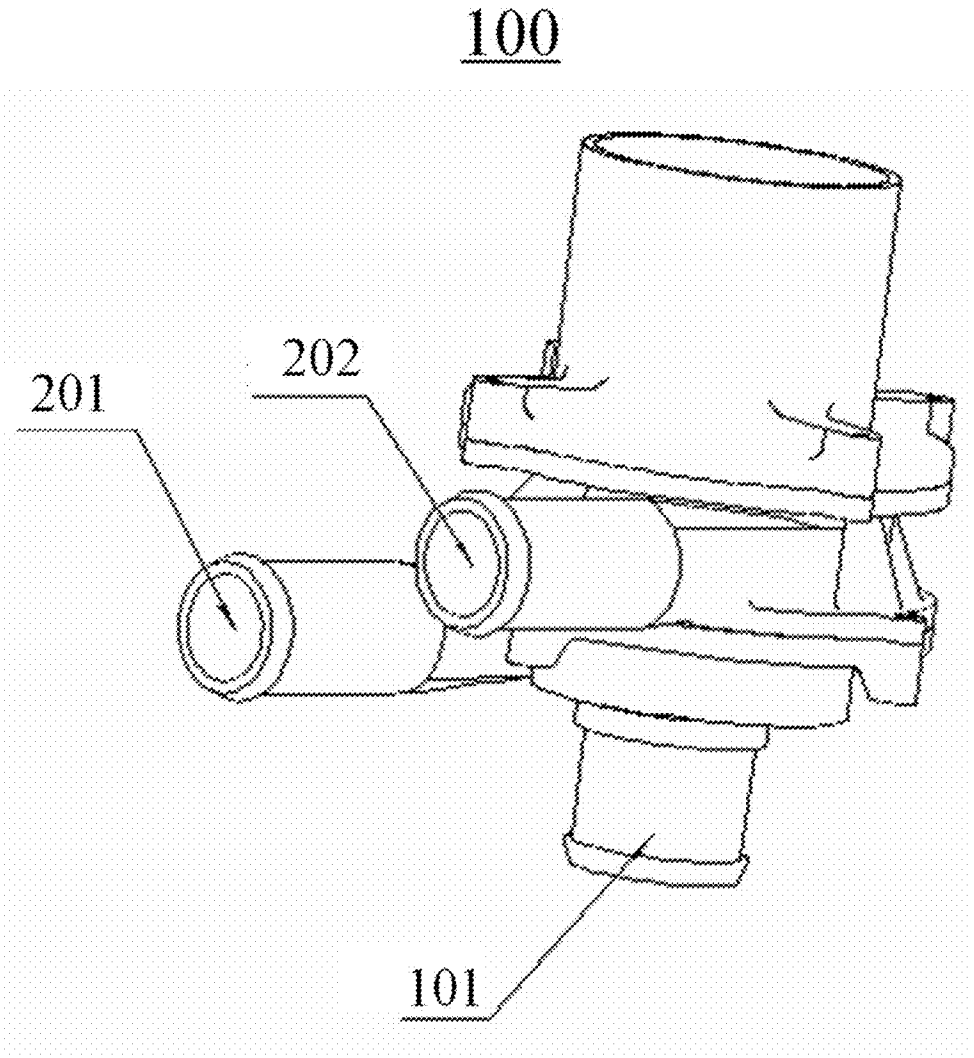
FIG. 1 illustrates a schematic diagram of the assembly structure of a one-inlet and two-outlet water pump, according to some embodiments.

The following provides a clear description of the technical solutions of the embodiments in this application, with reference to the accompanying drawings. Obviously, the described embodiments are only a portion, not all of the embodiments in this application. Based on the embodiments in this application, all other embodiments that can be obtained by a person of ordinary skill in the art without creative labor are within the protection scope of this application.

The terms in the embodiments in this application are only provided for the purpose of describing the specific embodiments, instead of limiting this application. The singular forms of "one", "the", and "this" in the embodiments and the claims in this application are also intended to include the majority forms, unless otherwise clearly stated above. In general, "many" generally includes at least two, but it is not ruled out that there may be at least one.

It should be understood that the term "and/or" in this application only shows the association relationships for describing associated objects and represents three relationships. For example, A and/or B represents three cases, i.e. existence of only A, existence of both A and B, or existence of only B. In addition, the symbol "/" generally represents the "or" relationship between the associated objects.

It should be understood that the terms "include", "comprise" or any other variants are intended to encompass non-exclusive inclusion, so that the processes, methods, articles or devices which include a series of elements don't only include those elements, but also include other elements not explicitly listed, or include the inherent elements of these processes, methods, articles or devices. Without further restrictions, the element limited by "include . . . " does not exclude other elements in the processes, methods, articles or devices same with the said element.

In the related art, water pumps of intelligent toilets are generally provided with one inlet and one outlet, with a unidirectional rotating impeller inside the water pump. The outlet is connected to the shunt valve which is equipped with a motor. The motor can drive the spool to rotate and change the angle of the spool, so as to adjust the flow rate and flushing duration of the lateral flushing path and the bottom flushing path. However, the shunt valve has a plurality of internal components, complex structure and high production costs. In addition, the complex path in the valve body increases the local loss, which requires higher lift of water pumps. Furthermore, it is necessary to detect the position of the shunt sheet in the shunt valve with a detection device in order to achieve diversion. Above factors increase the production and maintenance costs of intelligent toilets.

Based on above situation, this application provides a one-inlet and two-outlet water pump to solve the problem of increased costs caused by diversion using the shunt valve in the related art.

The water pump disclosed in this application can be used in field such as intelligent toilets.

Figure 2:
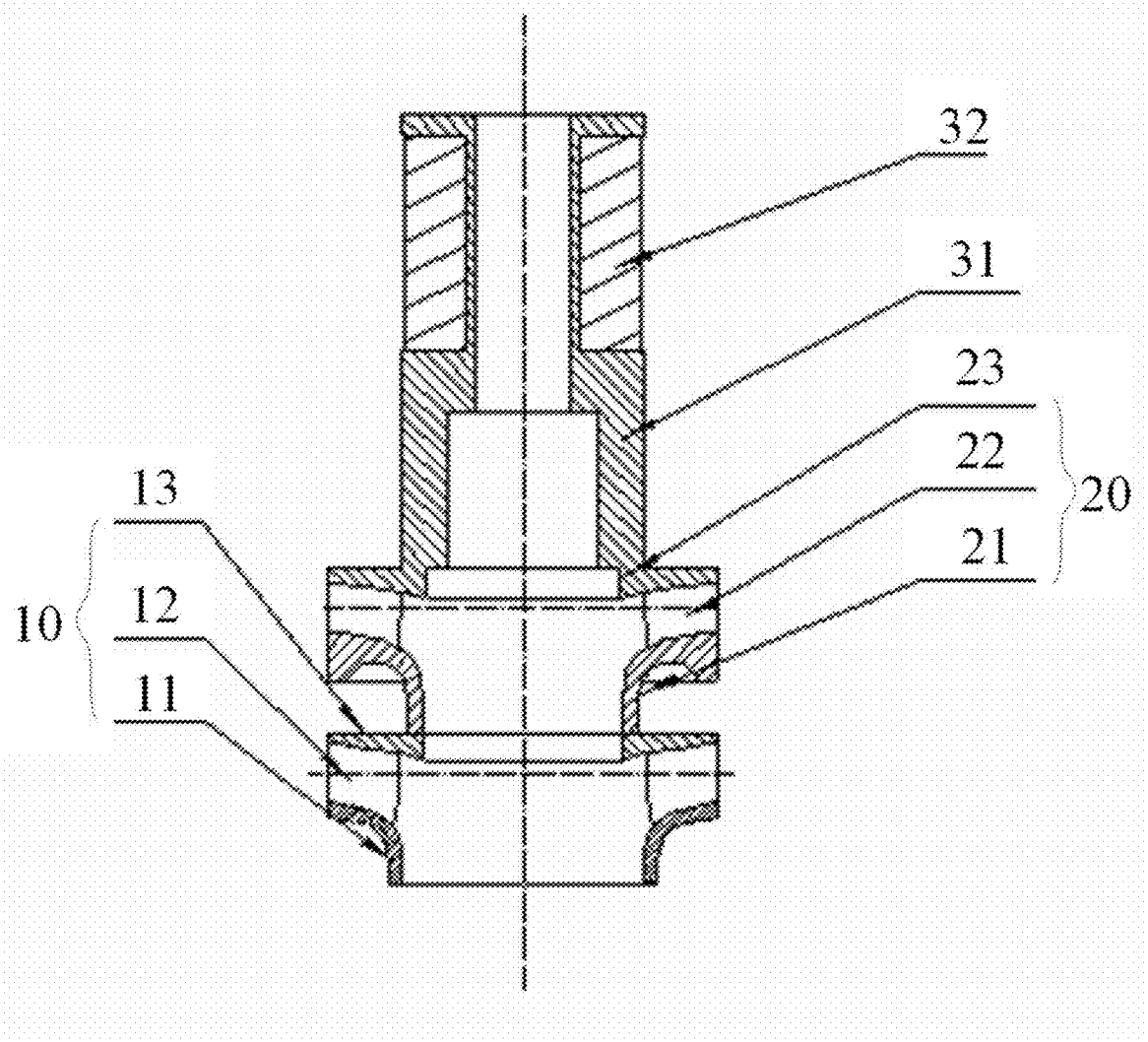
FIG. 2 illustrates a schematic diagram for connection of an impeller assembly and a motor assembly in FIG. 1, according to some embodiments.
Figure 3:
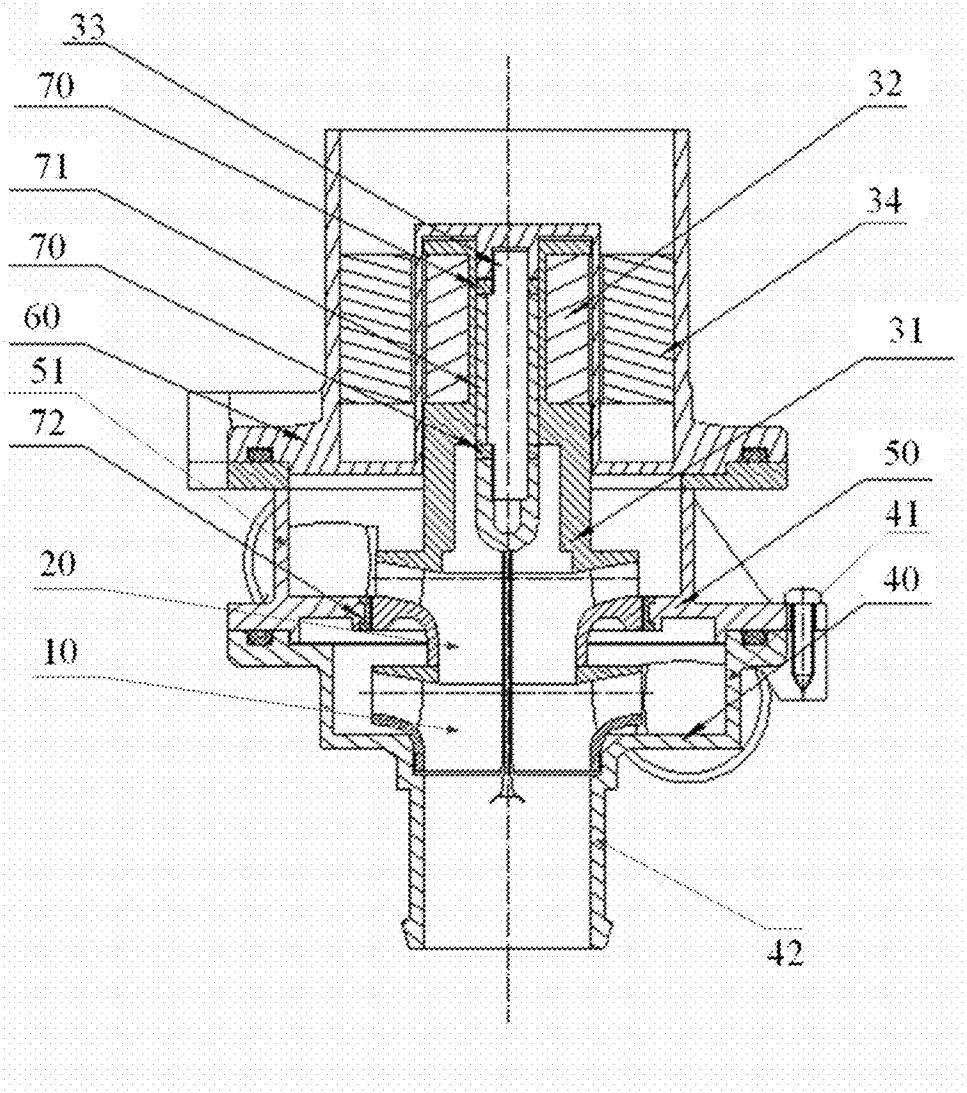
FIG. 3 illustrates a schematic diagram of the cross-sectional structure of the water pump in FIG. 1, according to some embodiments.

In an embodiment, referring to FIG. 1, FIG. 2, and FIG. 3, a one-inlet and two-outlet water pump is provided.

In this embodiment, the one-inlet and two-outlet water pump 100 comprises a pump body, and an impeller assembly and a motor assembly set inside the pump body; the motor assembly is connected to the impeller assembly. The impeller assembly comprises the first impeller 10 and the second impeller 20 which are connected to each other; a hollow cavity is formed between the first impeller 10 and the second impeller 20; wherein, the design rotation direction of the first impeller blade 12 is opposite to that of the second impeller blade 22. One end of the pump body is set with an inlet 101 which corresponds to one end of the first impeller 10 away from the second impeller 20. The side wall of the pump body is set with the first outlet 201 and the second outlet 202 which form a certain angle along the circumferential direction; the first outlet 201 is positioned near the first impeller 10 and the second outlet 202 is positioned near the second impeller 20; wherein, the motor assembly drives the impeller assembly to rotate when the motor assembly is excited, causing the liquid to flow into the hollow cavity from the inlet 101, and flow out of the first outlet 201 and the second outlet 202 after being pressurized by the first impeller 10 and the second impeller 20.

Wherein, the axis of the inlet 101 is on the same straight line as the axis of the hollow cavity, It should be understood that the pump body is set with an impeller assembly which comprises two impellers with opposite design rotation directions. In addition, the pump body is set with two outlets. The first outlet 201 is positioned near the first impeller 10 and the second outlet 202 is positioned near the second impeller 20. The liquid is pressurized by the first impeller 10 and the second impeller 20, and then flows out from the first outlet 201 and the second outlet 202 in order to achieve diversion.

In this embodiment, the first impeller 10 can be a semi-open impeller without a front cover plate, or a closed impeller with front and rear cover plates, and the second impeller 20 can be a closed impeller with front and rear cover plates.

In some embodiments, the first impeller 10 comprises the first impeller blade 12 and the first rear cover plate 13 which are fixedly connected; wherein, the first rear cover plate 13 is a hollow structure.

In some embodiments, the first impeller 10 comprises the first front cover plate 11 which is fixedly connected to the first impeller blade 12; the first front cover plate 11 is a hollow structure. In some specific embodiments, the both ends of the first impeller blade 12 are welded with the first front cover plate 11 and the first rear cover plate 13.

In some embodiments, the second impeller 20 comprises the second front cover plate 21, the second impeller blade 22, and the second rear cover plate 23 arranged in sequence; the second front cover plate 21 and the second rear cover plate 23 are fixedly connected to the second impeller blade 22 respectively; wherein, the second front cover plate 21 is a hollow structure. In some specific embodiments, both ends of the second impeller blade 22 are respectively welded to the second front cover plate 21 and the second rear cover plate 23.

In this embodiment, the first rear cover plate 13 of the first impeller 10 is fixedly connected to the second front cover plate 21 of the second impeller 20. In some embodiments, the first rear cover plate 13 is welded to the second front cover plate 21. In some embodiments, the first rear cover plate 13 and the second front cover plate 21 may be integrally formed.

It should be understood that, because the first front cover plate 11, the first rear cover plate 13 and the second front cover plate 21 are hollow, a hollow cavity is formed between the first impeller 10 and the second impeller 20. The hollow cavity is the main flow channel of the liquid.

In this embodiment, the first impeller 10 and the second impeller 20 are concentrically arranged.

In this embodiment, the curve from inlet edge to outlet edge of the first impeller blade 12 and the second impeller blade 22 is smooth, without large curvature variation, so as to improve the hydraulic efficiency of the impeller assembly. Further, the inlet edge of the second impeller blade 22 shrinks appropriately towards the outlet direction to avoid the influence on the inlet efficiency of the first impeller 10.

In this embodiment, the first impeller blade 12 comprises a plurality of first blades 120 evenly distributed along the circumferential direction; the second impeller blade 22 comprises a plurality of second blades 220 evenly distributed along the circumferential direction; wherein, the rotation direction of the first blades 120 is opposite to that of the second blades 220.

Figure 4A:
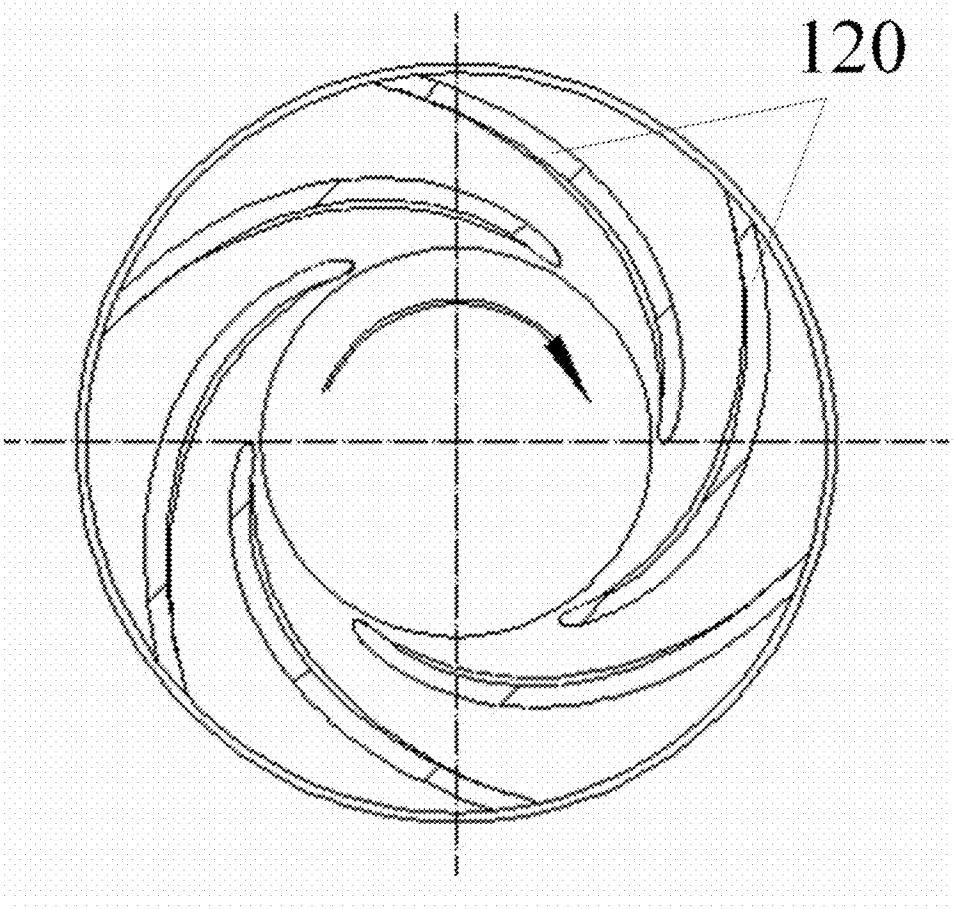
FIG. 4*a* illustrates a schematic diagram of a top view of the first impeller blade in FIG. 1, according to some embodiments.
Figure 4B:
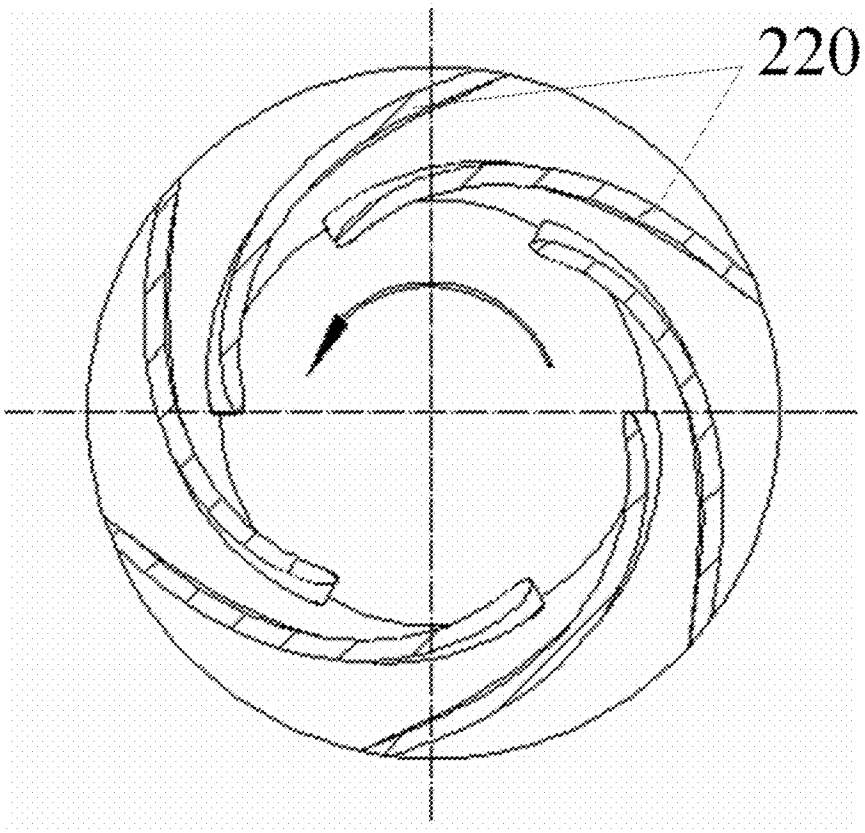
FIG. 4*b* illustrates a schematic diagram of a top view the a second impeller blade in FIG. 1, according to some embodiments.

Referring to FIG. 4*a* and FIG. 4*b*, FIG. 4*a* illustrates a schematic diagram of a top view of the first impeller blade in FIG. 1; FIG. 4*b* illustrates a schematic diagram of a top view of the second impeller blade in FIG. 1. In this embodiment, the plurality of first blades 120 rotate clockwise and the plurality of second blades 220 rotate anticlockwise.

In other embodiments, the plurality of first blades 120 may rotate anticlockwise and the plurality of second blades 220 may rotate clockwise. It is not limited in this application.

Referring to FIG. 1 to FIG. 3, in this embodiment, the motor assembly comprises a spindle 33, a stator 34, a rotor 32 and a rotor seat 31. The axis of the spindle 33 is in the same straight line as the axis of the pump body, the spindle 33 is contained in the hole of the rotor seat 31, and the rotor 32 is nested within the rotor seat 31 and set on the periphery of the spindle 33; the rotor seat 31 is fixedly connected to the second rear cover plate 23 of the second impeller 20.

In some embodiments, the rotor seat 31 is welded to the second rear cover plate 23. In some embodiments, the rotor seat 31 and the second rear cover plate 23 may be integrally formed. The formation of these components is not limited in this application.

In some embodiments, the stator 34 is isolated outside the flow channel, the rotor 32 is made of glue coated permanent magnet steel and the rotor 32 is soaked in water for better heat dissipation of the motor.

In some embodiments, the spindle 33 can not rotate, and both ends of the spindle 33 are fixed in the pump body through a U-shape support and a groove of the motor case 60.

In some embodiments, the first sliding bearing 71 is set between the rotor 32 and the spindle 33, with gaskets 70 positioned at both ends of first sliding bearing 71; wherein, the first sliding bearing 71 is tightly fitted with the rotor 32, and the inner ring of the first sliding bearing 71 rotates relative to the spindle 33. The spindle 33 bears the radial force transmitted by the first sliding bearing 71. The gasket 70 and the first sliding bearing 71 slide relatively to achieve the balance of axial force.

In other embodiments, the first sliding bearing 71 can be replaced with a rolling bearing. It is not limited in this application.

In this embodiment, when the motor assembly is excited, the rotor 32 drives the rotor seat 31 to rotate. The motor torque is directly transmitted to the second rear cover plate 23 of the second impeller 20 through the rotor seat 31, and then to the first rear cover plate 13 of the first impeller 10 through the second front cover plate 21, thereby achieving the torque transmission.

It should be understood that, in above design, the rotation speed of the first impeller 10 and the second impeller 20 is same as that of the motor assembly, enabling one motor to drive two impellers.

In this embodiment, the pump body comprises the first pump case 40, the second pump case 50 and a motor case 60 arranged in sequence; the first pump case 40 is set on the periphery of the first impeller 10, the second pump case 50 is set on the periphery of the second impeller 20 and the motor case 60 is set on the periphery of the motor assembly;

In some embodiments, the inlet case 42 is set with an inlet pipe, one end of the inlet pipe corresponds to the first impeller 10 away from the second impeller 20, and the axis of the inlet pipe is in the same straight line as the axis of the hollow cavity formed between the first impeller 10 and the second impeller 20 to improve the water inlet efficiency.

In some embodiments, the first pump case 40 is set with an inlet case 42 at the end away from the second pump case 50, and the first pump case 40 is set with the first outlet case 41 at the side wall corresponding to the first outlet 201; the second pump case 50 is set with the second outlet case 51 at the side wall corresponding to the second outlet 202 position on; the first outlet case 41 and the second outlet case 51 are offset by a certain angle along the circumferential direction.

In some embodiments, the angle between the first outlet case 41 and the second outlet case 51 is 30°~330°. In some embodiments, the angle between the first outlet case 41 and the second outlet case 51 may be 45°, 90°, 135°, 180°, or 270°.

It should be understood that, the first outlet case 41 and the second outlet case 51 may be set on opposite sides of the pump body or on the same side of the pump body, under the precondition of ensuring a certain angle to form a staggered setting.

In some embodiments, the first pump case 40 and the second pump case 50 may be designed in spiral curve.

In some embodiments, the first outlet case 41 and the second outlet case 51 are designed in spiral curve to fitted with the design rotation direction of the first impeller 10 and the second impeller 20, so as to increase the flow rate and lift of outlets.

In this embodiment, a pump cavity is formed between the first pump case 40 and the second pump case 50; wherein, the pump cavity is a cavity distinct from the hollow cavity, surrounding the impeller assembly.

In this embodiment, a connector (not indicated in the drawing) is set between the first pump case 40 and the second pump case 50; the connector is a hollow structure and set on the periphery of the second impeller 20; wherein, a separator is formed between the connector and the second front cover plate 21 of the second impeller 20 to separate the pump cavity into the first pump cavity and the second pump cavity so as to prevent liquid overflowing from the first outlet 201 from entering the second pump cavity.

In some embodiments, the connector is the upper cover plate of the first pump case 40 or the bottom plate of the second pump case 50. In some embodiments, to ensure a compact structure of the one-inlet and two-outlet water pump 100, the upper cover plate of the first pump case 40 also serves as the bottom plate of the second pump case 50, functioning as the abovementioned connector.

In some embodiments, the connector is nested with the second sliding bearing 72 near the second front cover plate 21 of the second impeller 2. Wherein, the second sliding bearing 72 is positioned near the second front cover plate 21; a small clearance may be formed between the second sliding bearing 72 and the second front cover plate 21 to bear the radial force transmitted by the second front cover plate 21, so as to reduce the pendulum and vibration of the one-inlet and two-outlet water pump 100 and improve the stable performance of the one-inlet and two-outlet water pump 100.

The second sliding bearing 72 may be omitted. It is not limited in this application.

In this embodiment, when the motor assembly rotates clockwise, the design rotation direction of the first impeller 10 is the same as the actual rotation direction. The water pressurized by the first impeller 10 flows out of the first outlet 201. At the first outlet 201, the flow rate and the lift are high. The design rotation direction of the second impeller 20 is opposite to that of the actual rotation direction. The water pressurized by the second impeller 20 flows out of the second outlet 202. At the second outlet 202, the flow rate and the lift are low. On the contrary, when the motor assembly rotates anticlockwise, the design rotation direction of the first impeller 10 is opposite to the actual rotation direction. At the first outlet 201, the flow rate and the lift are low. The design rotation direction of the second impeller 20 is the same as the actual rotation direction. At the second outlet 202, the flow rate and the lift are high.

In some embodiments, the first outlet 201 corresponds to the bottom flushing path, and the second outlet 202 corresponds to the lateral flushing path. When the motor assembly rotates clockwise, the flow rate and the lift of the bottom flushing path are high, making it suitable for flushing the bottom of intelligent toilets; when the motor assembly rotates anticlockwise, the flow rate and the lift of the lateral flushing path are high, making it suitable for flushing the side wall of intelligent toilets.

In this embodiment, the size of the first impeller 10 is equal to or greater than that of the second impeller 20. Wherein, the size includes diameter of inlet, outer diameter of outlet and width of outlet.

In some embodiments, the diameter of the inlet of the first impeller 10 is 17~26 mm (inclusive), the outer diameter of the outlet of the first impeller 10 is 30~42 mm (inclusive), the width of the outlet of the first impeller 10 is 4~20 mm (inclusive), and the number of the first blades 120 is 5~7 (inclusive). The inlet attack angle of the first blades 120 is 0~10° (inclusive), the outlet installation angle of the first blades 120 is 15~40° (inclusive) and the wrap angle of the first blades 120 is 90~120° (inclusive).

In some embodiments, the diameter of the inlet of the second impeller 20 is 17~26 mm (inclusive), the outer diameter of the outlet of the second impeller 20 is 30~42 mm (inclusive), the width of the outlet of the second impeller 20 is 4~18 mm (inclusive), and the number of the second blades 220 is 5~7 (inclusive). The inlet attack angle of the second blades 220 is 0~10° (inclusive), the outlet installation angle of the second blades 220 is 15~40° (inclusive) and the wrap angle of the second blades 220 is 90~120° (inclusive).

When the parameters of the first impeller 10 and the second impeller 20 are within the scope of above embodiments, and if the motor assembly rotates clockwise, the flow rate at the first outlet 201 is 25.5~38.2 L/min (inclusive), with the lift of 1.85~4.17 m (inclusive); at the second outlet 202, the flow rate is not higher than 10 L/min; if the motor assembly rotates anticlockwise, the flow rate at the first outlet 201 is not higher than 10 L/min; the flow rate at the second outlet 202 is 21.8~32.7 L/min (inclusive) and the lift is 2.12~4.76 m (inclusive).

Wherein, to ensure a wide high-efficiency area of the one-inlet and two-outlet water pump 100, the rotation speed of the motor is 4000~6000 rpm (inclusive).

In a embodiment, the diameter of the inlet of the first impeller 10 is 24 mm, the outer diameter of the outlet of the first impeller 10 is 39 mm, the width of the outlet of the first impeller 10 is 6 mm, and the number of the first blades 120 is 6. The inlet attack angle of the first blades 120 is 3~5° (inclusive), the outlet installation angle of the first blades 120 is 22°, and the wrap angle of the first blades 120 is 95°. The diameter of the inlet of the second impeller 20 is 20 mm, the outer diameter of the outlet of the second impeller 20 is 38 mm, the width of the outlet of the second impeller 20 is 5 mm, and the number of the second blades 220 is 6. The inlet attack angle of the second blades 220 is 3~5° (inclusive), the outlet installation angle of the second blades 220 is 22°, and the wrap angle of the second blades 220 is 95°. The matched rotation speed of the motor assembly is 5500 rpm. When the motor assembly rotates clockwise, the flow rate at the first outlet 201 is 35 L/min with the lift of 3.5 m; the flow rate at the second outlet 202 is not higher than 10 L/min; when the motor assembly rotates anticlockwise, the flow rate at the first outlet 201 is not higher than 10 L/min; the flow rate at the second outlet 202 is 30 L/min and the lift is 4.0 m.

It should be understood that, in the one-inlet and two-outlet water pump 100, the different rotation directions (clockwise and anticlockwise) of the impeller assembly and the change of rotation speed of the motor assembly can meet the different demands of intelligent toilets for flow rate and lift of two outlets. The pump replaces the shunt valve, so as to reduce the production and maintenance costs of intelligent toilets.

In some embodiments, the pump body is set with an impeller assembly which comprises two impellers with opposite design rotation directions. In addition, the pump body is set with two outlets. The first outlet is positioned near the first impeller, and the second outlet is positioned near the second impeller. After passing through the first impeller and the second impeller, the liquid flows out from the first outlet and the second outlet respectively, thereby achieving diversion. Further, two rotation directions of the impeller assembly and the change of rotation speed of the motor assembly can meet the different demands of intelligent toilets for flow rates and lifts of two outlets. The pump replaces the shunt valve, so as to reduce the production and maintenance costs of intelligent toilets.

The above content is only the embodiments in this application and constitutes no limitation to the scope of the patent in this application. Any equivalent structure or equivalent process transformation made by reference of the specification and accompanying drawings in this application, or direct or indirect application in other related technical fields are included in the protection scope of the patent of this application.

What is claimed is:

1. A one-inlet and two-outlet water pump, comprising:

a pump body; and an impeller assembly and a motor assembly set inside the pump body, wherein the motor assembly is connected to the impeller assembly, wherein the impeller assembly comprises a first impeller and a second impeller connected to each other, with a hollow cavity formed between the first impeller and the second impeller, the first impeller having a first rear cover plate and the second impeller having a second rear cover plate;

wherein a design rotation direction of a first impeller blade is opposite to that of a second impeller blade;

wherein an inlet is set at one end of the pump body, corresponding to one end of the first impeller away from the second impeller;

wherein a first outlet and a second outlet are set on a side wall of the pump body, with the first outlet and the second outlet offset by a certain angle along a circumferential direction;

wherein the first outlet is positioned near the first impeller and the second outlet is positioned near the second impeller; and wherein the motor assembly comprises a rotor seat that is fixedly connected to the second rear cover plate of the second impeller, and in response to being excited, the motor assembly drives the impeller assembly to rotate, causing liquid to flow into the hollow cavity from the inlet and flow out of the first outlet and the second outlet after being pressurized by the first impeller and the second impeller.

2. The one-inlet and two-outlet water pump according to claim 1, wherein the first impeller comprises the first impeller blade and the first rear cover plate arranged in sequence, with the first impeller blade fixedly connected to the first rear cover plate;

wherein the second impeller comprises a second front cover plate, the second impeller blade, and the second rear cover plate arranged in sequence, with the second front cover plate and the second rear cover plate fixedly connected to the second impeller blade respectively; and wherein the first rear cover plate is fixedly connected to the second front cover plate, and both the first rear cover plate and the second front cover plate are hollow structures.

3. The one-inlet and two-outlet water pump according to claim 2, wherein the first impeller blade comprises a plurality of first blades evenly distributed along the circumferential direction;

wherein the second impeller blade comprises a plurality of second blades evenly distributed along the circumferential direction; and wherein a rotation direction of the first blades is opposite to that of the second blades.

4. The one-inlet and two-outlet water pump according to claim 3, wherein the first impeller and the second impeller are concentrically arranged, and a size of the first impeller is equal to or greater than that of the second impeller.

5. The one-inlet and two-outlet water pump according to claim 2, wherein the motor assembly further comprises a spindle and a rotor, wherein an axis of the spindle is in a same straight line as an axis of the pump body, the spindle is contained in a hole of the rotor seat, and the rotor is nested within the rotor seat and set on a periphery of the spindle.

6. The one-inlet and two-outlet water pump according to claim 5, wherein a first sliding bearing is set between the rotor and the spindle, with gaskets positioned at both ends of the first sliding bearing; and wherein the first sliding bearing is tightly fitted with the rotor, and an inner ring of the first sliding bearing rotates relative to the spindle.

7. The one-inlet and two-outlet water pump according to claim 2, wherein the pump body comprises a first pump case, a second pump case, and a motor case arranged in sequence;

wherein the first pump case is set on a periphery of the first impeller, the second pump case is set on a periphery of the second impeller, and the motor case is set on a periphery of the motor assembly;

wherein an inlet case is set at an end of the first pump case away from the second pump case, and a first outlet case is set on a side wall of the first pump case corresponding to the first outlet;

wherein a second outlet case is set at a side wall of the second pump case corresponding to the second outlet; and wherein the first outlet case and the second outlet case are offset by a certain angle along the circumferential direction.

* * * * *